US005778991A

United States Patent [19]

Runquist et al.

[11] Patent Number: 5,778,991

[45] Date of Patent: Jul. 14, 1998

[54] DIRECTIONAL BORING

[75] Inventors: Randy R. Runquist, Lovilia; James R. Rankin, Montezuma; Mark VanHouwelingen, Knoxville, all of Iowa

[73] Assignee: Vermeer Manufacturing Company, Pella, Iowa

[21] Appl. No.: 705,007

[22] Filed: Aug. 29, 1996

Related U.S. Application Data

[63] Continuation-in-part of Ser. No. 618,541, Mar. 4, 1996, abandoned.

[51] Int. Cl.[6] ..... E21B 7/06

[52] U.S. Cl. ..... 175/61; 175/73; 175/398

[58] Field of Search ..... 175/61, 73, 398

[56] References Cited

U.S. PATENT DOCUMENTS

| | | | |
|---|---|---|---|
| Re. 33,793 | 1/1992 | Cherrington et al. . | |
| 2,300,016 | 1/1942 | Scott et al. . | |
| 2,324,102 | 7/1943 | Miller et al. . | |
| 2,783,972 | 3/1957 | Fehlmann . | |
| 3,525,405 | 8/1970 | Coyne et al. . | |
| 3,529,682 | 9/1970 | Coyne et al. . | |
| 3,536,151 | 10/1970 | Aarup . | |
| 3,878,903 | 4/1975 | Cherrington . | |
| 4,144,941 | 3/1979 | Ritter . | |
| 4,262,758 | 4/1981 | Evans | 175/73 |
| 4,396,073 | 8/1983 | Reichman et al. . | |
| 4,416,339 | 11/1983 | Baker et al. . | |
| 4,453,603 | 6/1984 | Voss et al. . | |
| 4,632,191 | 12/1986 | McDonald et al. . | |
| 4,637,479 | 1/1987 | Leising | 175/61 |
| 4,674,579 | 6/1987 | Geller et al. . | |
| 4,679,637 | 7/1987 | Cherrington et al. . | |
| 4,694,913 | 9/1987 | McDonald et al. . | |
| 4,714,118 | 12/1987 | Baker et al. . | |
| 4,787,463 | 11/1988 | Geller et al. . | |
| 4,823,888 | 4/1989 | Smet . | |
| 4,856,600 | 8/1989 | Baker et al. | 175/61 |
| 4,858,704 | 8/1989 | McDonald et al. . | |
| 4,867,255 | 9/1989 | Baker et al. | 175/61 |
| 4,953,638 | 9/1990 | Dunn . | |
| 4,991,667 | 2/1991 | Wilkes, Jr. et al. | 175/61 |
| 5,020,608 | 6/1991 | Oden et al. | 175/61 |
| 5,148,880 | 9/1992 | Lee et al. . | |
| 5,289,887 | 3/1994 | Puttmann | 175/61 |
| 5,421,420 | 6/1995 | Malone et al. | 175/61 |
| 5,449,046 | 9/1995 | Kinnan . | |
| 5,513,713 | 5/1996 | Grooves | 175/73 |
| 5,553,678 | 9/1996 | Barr et al. | 175/73 |

FOREIGN PATENT DOCUMENTS

| | | |
|---|---|---|
| 0209217 | 7/1991 | European Pat. Off. . |
| 0 467 642 A2 | 1/1992 | European Pat. Off. . |
| 53-114286 | 6/1981 | Japan . |

*Primary Examiner*—Hoang C. Dang
*Attorney, Agent, or Firm*—Merchant, Gould, Smith, Edell, Welter & Schmidt, P.A.

[57] ABSTRACT

A directional boring apparatus is disclosed where the apparatus is controlled through a method which includes deviating a drill head from a straight path into a desired direction angled away from the straight path. The deviation is achieved by applying an axial force to the drill head when a drill head cutting member is positioned within an arc of rotation through which the desired direction passes. The drill head is retracted when the cutting member is outside of the arc of rotation.

29 Claims, 6 Drawing Sheets

DIRECTIONAL BORING

This is a continuation-in-part of application Ser. No. 08/618,541, filed Mar. 4, 1996, now abandoned.

I. BACKGROUND OF THE INVENTION

1. Field of the Invention

This invention pertains to underground boring apparatus and methods. More particularly, this invention pertains a method for underground boring to control a direction of a boring member.

2. Description of the Prior Art

In the prior art, there are many examples of directional boring machines. An example of such is shown in U.S. Pat. No. 4,858,704. In the '704 patent, a drilling head is secured to an end of a drill string. Through operation of above-ground apparatus, the drill string is rotated about its axis causing the drill head to rotate about its axis. When it is desired to advance the drill string in a straight line, the drill string is simultaneously rotated about its axis and axially advanced. When it is desired to deviate the direction of drilling from the straight line path, the drill string is positioned in a desired angular rotation and further rotation of the drill string is ceased. Then, the drill string is axially advanced without substantial rotation. The geometry of the drill head results in the drill head and coupled drill string being deflected from the straight path as the drill string is axially advanced without rotation. Once a desired amount of deviation is achieved, rotation commences with the drill string being simultaneously axially advanced and rotated such that the drill head now proceeds in a straight line. Similar methods of operation are disclosed in U.S. Pat. Nos. 4,953,638 and 5,148,880.

In the aforementioned prior art patents, the drill string is advanced by pushing on the drill string causing it to be forced through the medium (i.e., dirt, rock, etc.) through which boring is desired. For certain mediums (for example, rock), it is very difficult to force a drill string axially through the medium. By pushing a drill string through rock, the drill string is using compressive forces to cause the rock to fail and clear a path for the drill head. However, rock is very strong in response to compressive forces. For example, a common type of generally soft rock is well known "Caliche" rock. Caliche rock can have a compressive strength in excess of 5000 psi while its shear strength is 2000 psi and its tensile strength is less than 1000 psi. The aforementioned prior art devices must advance the drill head with sufficient power to overcome the compressive strength of the rock which, in fact, is the strongest force of the rock through which boring is desired.

Certain prior art devices use a hammer affect in attempts to drill through a medium such as rock or the like. For example, U.S. Pat. No. 4,694,913 supplies compressed air to the drilling head which contains a hammer and anvil operated by the compressed air. The desired affect is a percussive impact on the boring head to pierce the earth. However, even in percussive action, the drilling operation is still attempting to overcome the compressive force of the rock which is the strongest force on the rock. This is particularly true in a prior art apparatus such as the '913 patent which does not rotate the boring head when it is desired to deviate the boring head from a straight path.

U.S. Pat. No. 5,449,046 teaches an underground boring apparatus. In the '046 patent, the drill string is rotated throughout operation even when it is desired to deviate the drill string from a straight path. The drill head includes a mechanism for applying a lateral impulse force when the drill head is in a desired rotational orientation to cause the drill head to deflect away from a straight path. For example, the '046 patent, the drill head pulses against a wall of a bore hole causing the drill head to move away from the wall. The pulse occurs once every revolution. Alternatively, FIG. 4 of the '046 patent illustrates an internal hammer mechanism which, in cooperation with an angled face on a cutting member causes the drill head to deviate from a straight line. The pulsing in FIG. 4 is also intermittent and occurs when the drill head is in a desired orientation with the impacting occurring once per revolution of the drill head.

In the '046 patent, hammer action such as that shown in FIG. 4 still acts against the compressive strength of the rock. Further, to the extent any impulse action of the '046 patent assists in drilling, the impulse only occurs once per revolution for a very limited time.

It is an object of the present invention to provide an apparatus and method for a directional earth boring apparatus which includes an improved method and apparatus for controlling a direction of the boring apparatus through the earth.

II. SUMMARY OF THE INVENTION

According to a preferred embodiment of the present invention, a method is disclosed for controlling a drilling apparatus for drilling a bore hole through a medium such as rock, earth or the like. The apparatus includes a drill string terminating at a drill head having a cutting member which rotates about an axis of rotation with the cutting member offset from the axis. A drive axially advances the drill head as well as rotates the drill head. The method of the invention includes advancing the drill head in a desired direction angled away from a straight path by applying an axial force to the drill head when the cutting member is in an arc of rotation through which the desired direction passes and relaxing the axial force when the cutting member is outside of the arc of rotation. The relaxing includes retracting the drill head such that the cutting member clears a partially excavated end of the bore hole to define a ramp for forcing the drill head in the desired direction.

III. BRIEF DESCRIPTION OF THE DRAWINGS

FIG. 1 is a schematic representation of a drilling apparatus for directional boring through dirt, rock or the like;

IV. DESCRIPTION OF THE PREFERRED EMBODIMENT

Referring now to the several drawing figures in which identical elements are numbered identically throughout, a description of the preferred embodiment of the present invention will now be provided.

Figure 1:
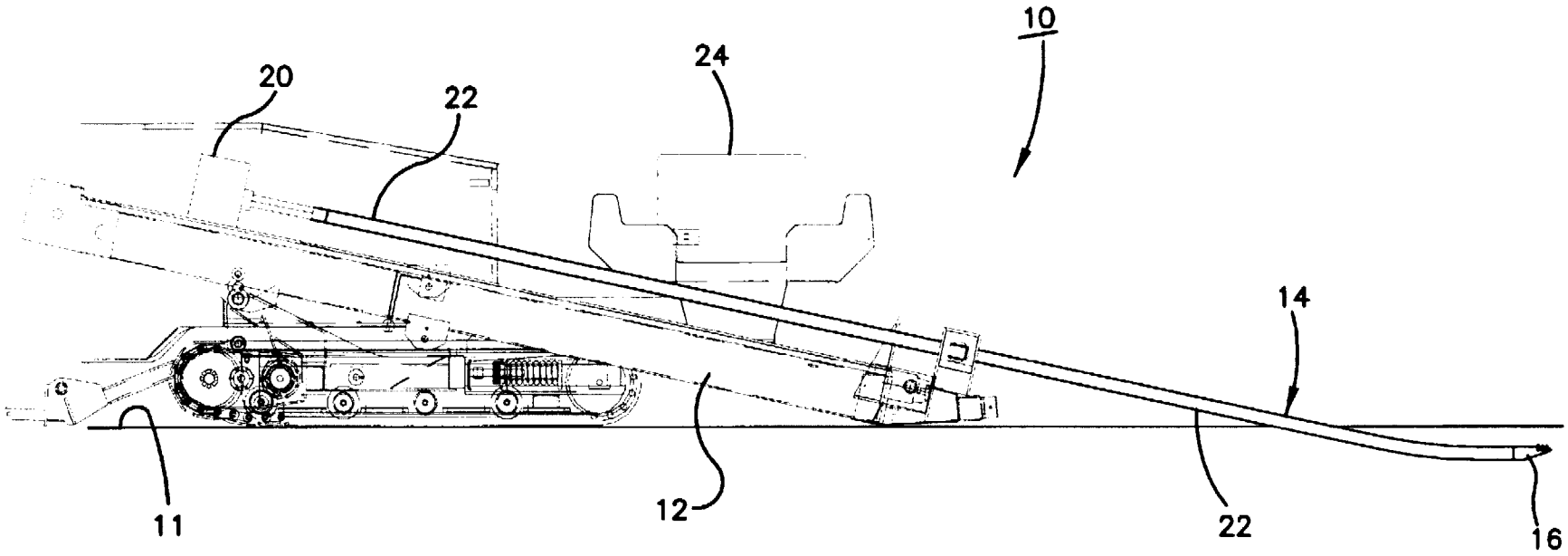

Referring initially to FIG. 1, a drilling apparatus 10 is disclosed. The drilling apparatus 10 includes a support 12 mounted on the ground 11 and angled to direct a drill string 14 to penetrate the ground 11. The drill string 14 terminates at a drill head 16 which includes a cutting member 18 (FIGS. 2–4) for cutting away dirt, rock or the like. A drive mechanism 20 is provided for both rotating the drill string 14 and forcing the drill string 14 in a longitudinal direction.

Figure 2:
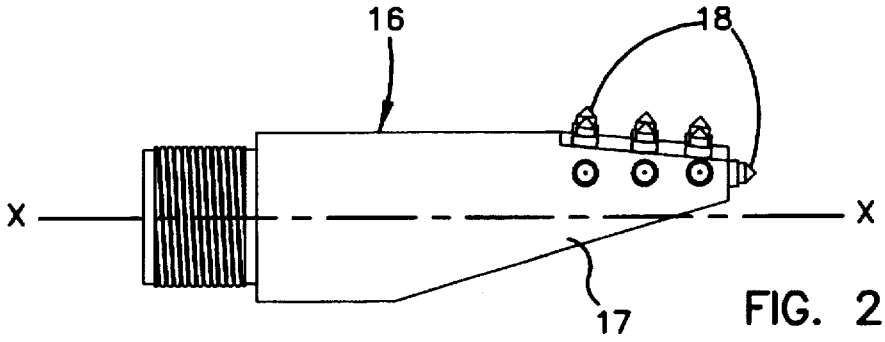
FIG. 2 is a side elevation view of a representative drill head for use in the present invention.
Figure 3:
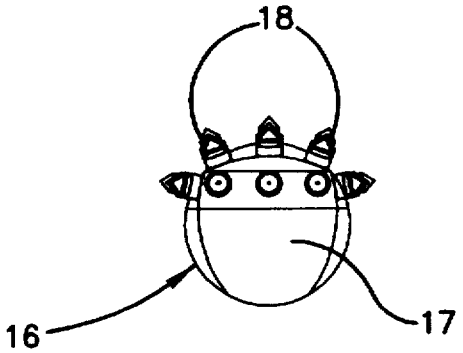
FIG. 3 is a front end view of the drill head of FIG. 2.
Figure 4:
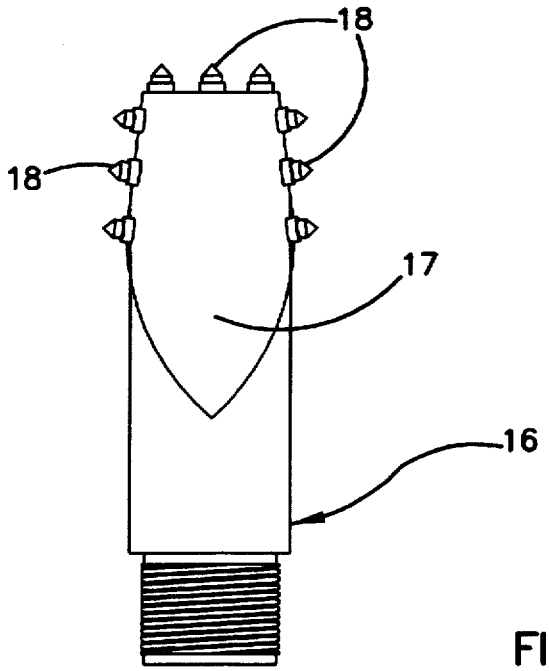
FIG. 4 is a bottom plan view of the drill head of FIG. 2.

FIGS. 2–4 show a conventional drill head 16. The head 16 is coupled to a terminal end of the drill string 14. The head 16 includes a cutting member 18 (such as cutting teeth 18) for cutting rock, dirt or the like as the drill string 14 is rotated. The teeth are offset from the axis X—X about which they rotate as drill string 14 rotates. The drill head 16 is angled at flat 17 on a side thereof 180° opposite teeth 18. Drill heads come in a wide variety of geometries. Examples of such are shown in U.S. Pat. Nos. 5,242,026 and 5,341,887. While a particular drill head 16 is shown for purposes of illustrating the present invention, any number of different designs can be used with the present invention.

The drill string 14 comprises a plurality of rod segments 22. After a rod segment 22 has been axially (i.e., longitudinally) advanced, the drive 20 is decoupled from the drill string 14 and is retracted so that a new rod segment 22 may be loaded onto the apparatus 10. A new rod segment 22 is threadedly connected to the drill string 14. After attachment of the new rod segment 22 to the drill string 14, the rod segment 22 is now part of the drill string 14 and the entire drill string 14 is once again both rotated and/or longitudinally advanced by the drive 20.

The drive 20 is controlled by a controller 24 which is schematically shown in FIG. 1. The controller 24 controls whether the drive 20 is rotating the drill string 14, advancing the drill string 14 or whether the drive 20 is retracting to permit placement of a new rod segment 22 on the apparatus 10.

The rod segments 22 are metal and are sufficiently rigid to transmit rotational and axial forces from the drive 20 to the drill head 16. The drill string 14 (although composed of rigid segments 22) is sufficiently flexible so that the string 14 can follow a curved path.

It will be appreciated that a drilling apparatus 10 thus far described is well known in the prior art and forms no part of this invention per se. Instead, the present invention is directed to a novel method of operation of the drilling apparatus 10. More particularly, the present invention is directed to a novel method of operation which includes intermittent retraction of the drill string 14 during the drilling operation to control a direction of movement of the drill head 16.

Figure 5:
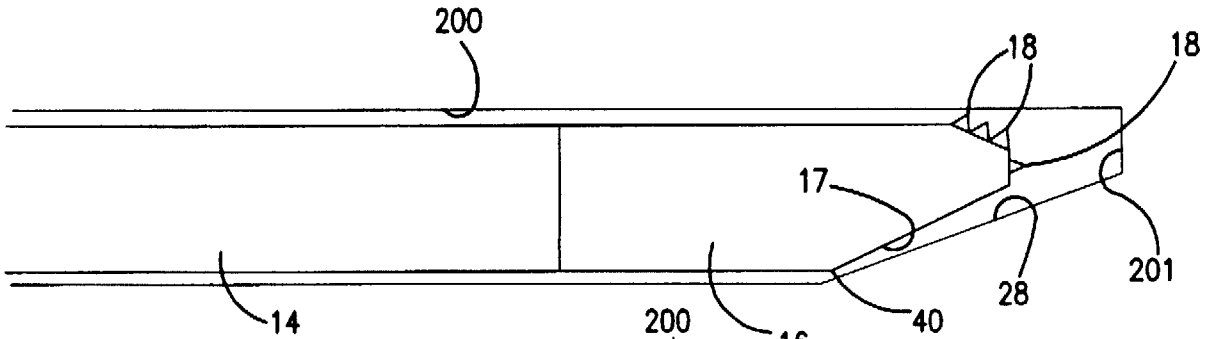
FIG. 5 is a schematic representation of a drill head and attached drill string inserted within a bore.
Figure 6:
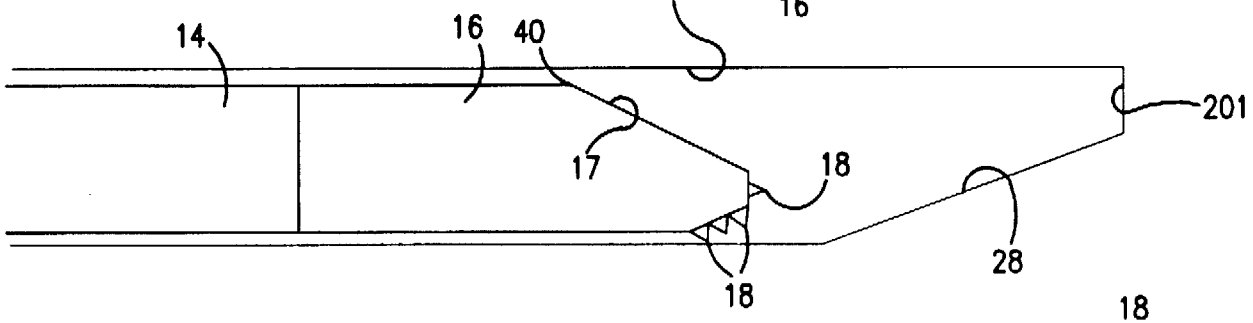
FIG. 6 is the view of FIG. 5 with the drill head retracted and rotated 180°.
Figure 7:
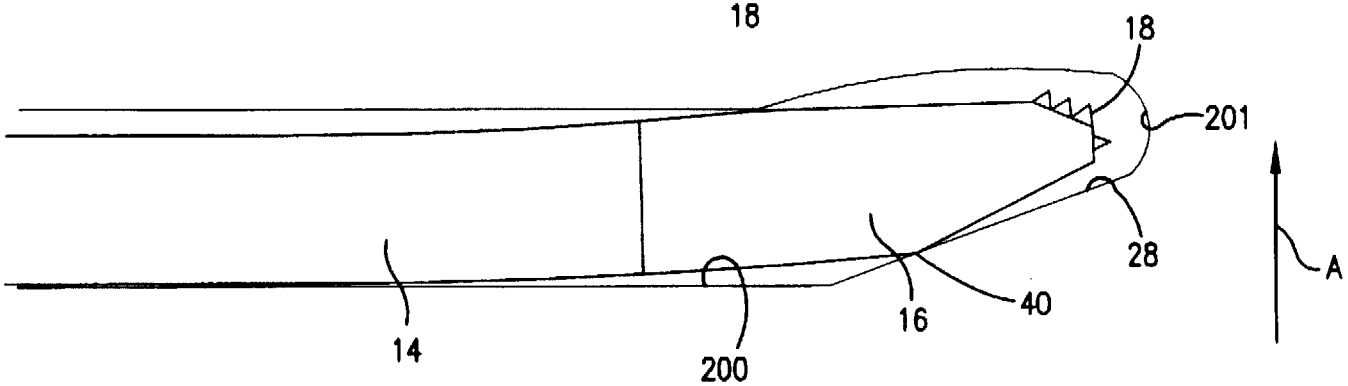
FIG. 7 is the view of FIG. 6 with the drill head further inserted and rotated.

During the drilling operation, the geometry of the drill head 16 and offset cutting member 18 cut through rock such that after partial rotation of the drill head 16 about its axis X—X, a portion of rock is cut away as waste and a remaining portion remains in the bore. This is best illustrated in FIGS. 5–7 where the drill head 16 and cutting member 18 are illustrated within a bore hole 200 and where the geometry of the drill head 16 is such that in the absence of complete rotation of the drill head 16 about its axis X—X, a portion of the bore hole remains uncut and defines a ramp or cam surface 28. Recognizing the formation of ramp surface 28, Applicants have devised a novel method for controlling the drilling apparatus 10 which takes advantage of the formation of a ramp surface 28 in order to direct a drill head 16 in a desired direction angled away from a straight path.

Figure 8:
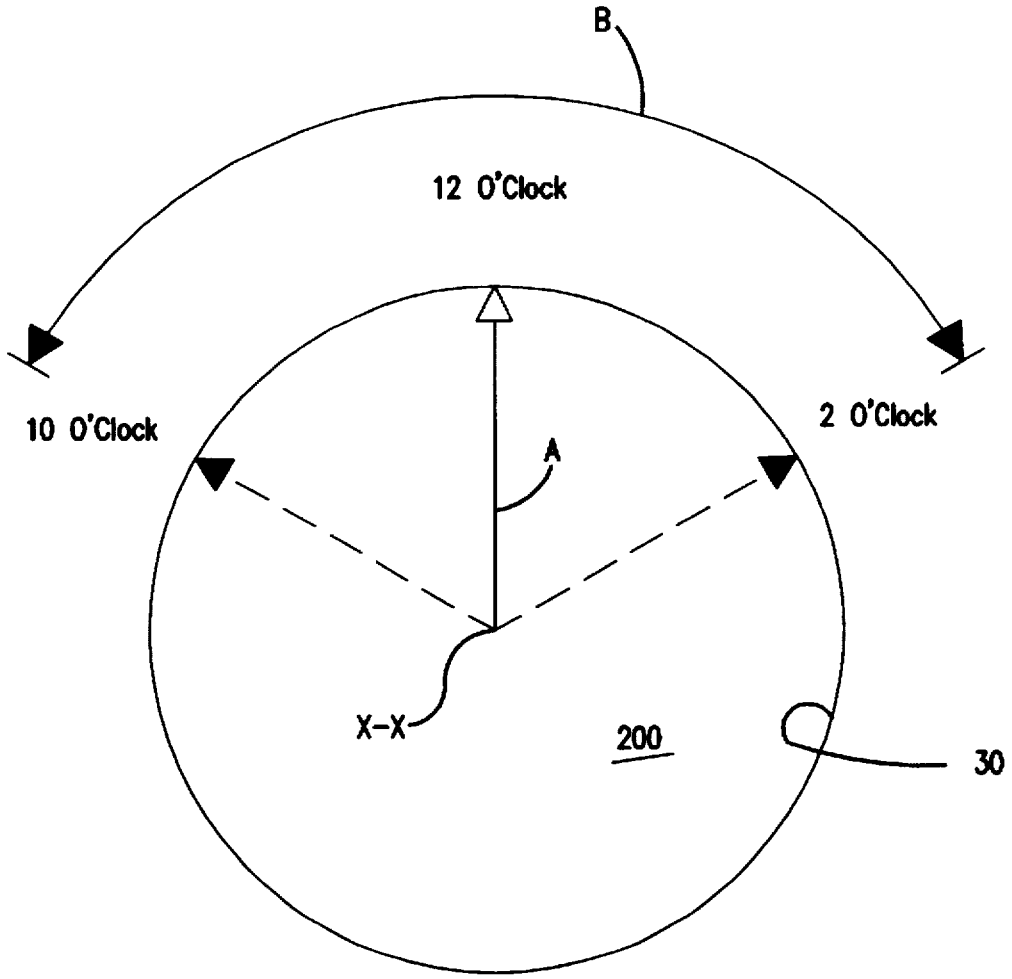
FIG. 8 is a schematic representation showing an arc of cutting used in the method of the present invention.

The present method is best described with initial reference to FIG. 8, a path 30 defined by cutting member 18 as drill head 16 rotates about an axis X—X as the drill string 14 is rotated by the drive 20. As the drill string 14 is constantly rotated and longitudinally advanced, the cutting member 18 follows the path of circle 30. As a result, a straight bore 200 having generally circular cross-section is formed. The drive 20, through well-known hydraulic controls, maintains the cutting head 18 forced against a terminal end 201 (FIGS. 5–7) of the bore 200 (and hence, against a rock to be cut) with a predetermined force in order to attain the most efficient cutting by the cutting member 18. For example, with Caliche rock, it is desired that the cutting member 18 be maintained against the face of the Caliche rock at about 2500 psi for the cutting member 18 to remove rock most efficiently. Since a constant forward thrust is being applied at 2500 psi and since the cutting member 18 is removing rock constantly throughout a constant rotation, the drill string 14 is being longitudinally and axially advanced along a straight line following axis X—X.

From time to time, it may be desired to deflect the drill head 16 away from the straight path in a desired direction of deviation. For example, it may be desired to deflect the drill head 16 upwardly in a generally vertical direction indicated by a twelve o'clock position and direction of deviation A in FIG. 8.

To achieve desired deflection in the twelve o'clock direction A, the present invention includes advancing the drill head 16 with the cutting force (i.e., 2500 psi in the event of Caliche rock) applied when the cutting member 18 is within a prescribed arc of rotation B (for example, between the ten o'clock position and the two o'clock position in FIG. 8). The arc of rotation B is bisected by the desired direction A of deflection.

When the cutting member 18 is outside of the arc B of rotation, the drill string 14 is retracted by the drive 20 such that the cutting member 18 is not cutting against the face of the rock at the terminal end 201 of the bore 200. Specifically, after completion of the cutting throughout the arc B of rotation, the drill string 14 is retracted by retracting the drive 20 such that the cutting head 18 is retracted a distance sufficient for the cutting head 18 to complete its rotation without cutting away from any of the ramp surface 28.

In the specific example given, the arc of rotation B is from the ten o'clock to the two o'clock position in FIG. 8. Therefore, during rotation, when the drill head 16 is in the ten o'clock position, the drill string 14 is advanced by longitudinally advancing the drive 20. The drill string is advanced such that when the cutting member 18 engages rock, it is urged against the rock face with a desired force for efficient cutting (for example, 2500 psi). The cutting member 18 remains urged against the rock face throughout the arc B until the two o'clock is attained at which point the drive 20 is retracted. Throughout the operation, the drive 20 continues to rotate the drill string 14 in a continuous rotation at any selected desired rate of rotation (for example, 70 rpm).

As the cutting member 18 is engaging the rock surface and cutting throughout the arc of rotation B, it is failing the face of the rock in both tensile and shear. Therefore, the present method avoids compressive resistance of the rock and cuts away from the rock against its least resistive forces.

During the cutting operation in the arc B of rotation, the cutting member 18 is removing rock from the face (for example, to a depth of about two inches for each rotation). Therefore, as the cutting member 18 approaches the ten o'clock and is further advanced into the bore hole 200, the drill head 16 is longitudinally advanced about two inches beyond its position in the previous cutting along arc B. As the cutting member 18 is further advanced, a surface (conveniently referred to herein as a cam follower surface 40) under either the drill string or the drill head engages the ramp 28 (see FIG. 7). Longitudinal thrusting of the drill string 14 causes the cam follower surface 40 to engage the ramp surface 28 which deflects the drill head 16 (and hence the cutting member 18) along the desired direction of deflection A.

The aforementioned process of incrementally cutting only during the arc B of rotation and retracting the drill string 14 and drill head 16 throughout the remainder of the rotation results in incrementally advancing the drill head 16 both longitudinally and deflected in the desired direction A. Once the drill head 16 has been fully deflected, the retraction step can be terminated and rotation and longitudinal advancement without retraction resumes for the drilling string to be moved along a straight path.

Figure 9:
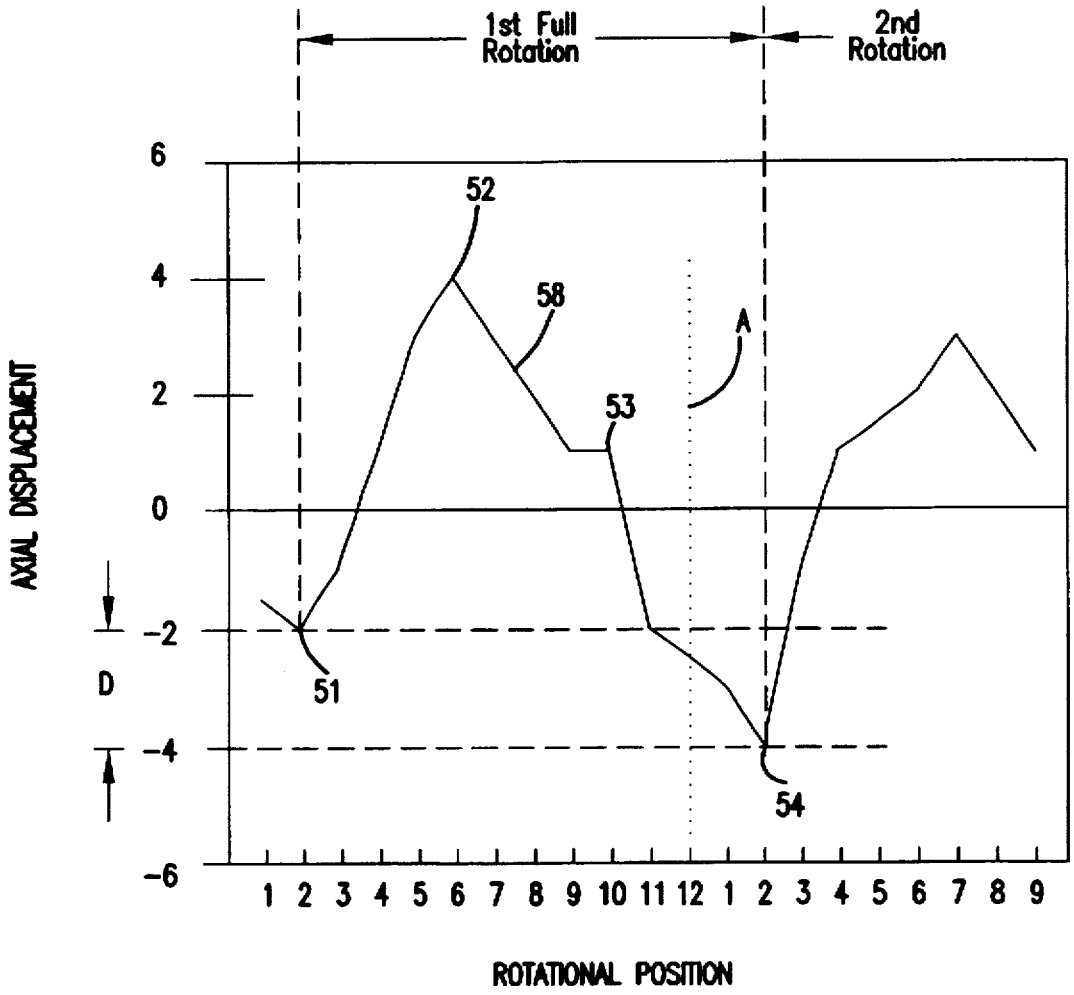
FIG. 9 is a graph showing relative axial and rotational position of the drill head throughout the method of the present invention.

FIG. 9 illustrates a common plot of the displacement of the drill head 16 during the method of the present invention. In FIG. 9, the horizontal axis is the rotational position of the drill head 16. In the vertical axis, the axial displacement is indicated (in inches) with a negative value indicating penetration into the bore hole from an arbitrarily selected start position (the zero position) and a positive value representing a retraction relative to the start position. In FIG. 9, the horizontal axis is numbered corresponding with positioning on a clock with twelve o'clock representing a vertical "up" and six o'clock representing vertical "down". FIG. 9 presents a graph 50 showing the relative axial displacement of the drill head 16 for two rotations of the drill head 16 about the axis X—X. FIG. 9 pertains to the aforementioned example where the desired direction of deflection A is the twelve o'clock position and where axial thrusting commences at the ten o'clock position and retraction commences at the two o'clock position.

As shown in FIG. 9, and illustrated at point 51, the drill head 16 is fully advanced at the two o'clock position (i.e., at the end of the cutting arc B of rotation of the previous cycle). As rotation continues, the drill head 16 is retracted until it is fully retracted at point 52 which corresponds to the six o'clock position which is 180° opposite of the desired direction of deflection A (corresponding to the twelve o'clock position). At the fully retracted position 52, the drill string 14 is longitudinally advanced and the drill head 16 engages the rock face 20 at the ten o'clock position 53 at which point cutting commences. Cutting continues with continuing advancement of the drill head 16 until the next two o'clock position 54 at which point retraction commences and the cycle continues.

It will be noted that the desired direction A of deflection is mid-point between the beginning cutting position 53 and the end cutting position 54. Further, since the drill head 16 is being simultaneously advanced while removing waste material, there is a net penetration D between the two o'clock position 51 at the start of the cycle and the two o'clock position 54 at the end of the cycle.

In a preferred method of operation, the rotation versus the axial positioning of the drill head 16 is not a linear function. Instead, the axial advancement and retraction is an exponential function relative to the rotational position. In other words, when the drilling head 16 is retracted starting at the two o'clock position, it is retracted at a progressively increasing rate relative to the rotational velocity in order to avoid the cutting member 18 from cutting away from the ramp material 28.

In order to perform the above-described method of operation of the drilling apparatus 10, the true rotational orientation of the drill head 16 must be determined. Thereafter the rotational position of the head 16 can be calculated by controller 24. For example, the controller can presume that drill head 16 has rotated 90° after the drive 20 has rotated 90°.

Even though the true orientation of the drill head 16 can be initially determined (and subsequently calculated by monitoring the amount of rotation of the drill string 14 by the drive 20 to calculate a calculated rotational position), the true rotational position may subsequently become out of alignment with the calculated rotational position. For example, as additional rod segments 22 are added to the drill string 14, the actual rotational position of the drill head 16 may be out of alignment with the calculated rotational position due to tolerances and other inaccuracies resulting from threadedly attaching rod segments 22 to the drill string 14. Therefore, it is preferred that the actual position of the drill head 16 be calculated after a rod segment 22 is threadedly attached to the drill string 14.

The actual angular position of the drill head 16 can be calculated in many ways known in the art. For example, the drill head 16 may contain a transmitter or the like (not shown) transmitting its rotational position which can be radio transmitted to a receiver (not shown) above ground as is common in the art. The operator can rotate drill string 14 until the drill head is in a start position (e.g., the twelve o'clock position). Once the drill head 16 is positioned in a monitored position equal to the twelve o'clock position, a reset button or the like can be pressed on the controller 24 to reset the starting angular position at the twelve o'clock position. Subsequent to the reset, the amount of rotational movement of the drive 20 may be used to calculate the angular position of the drill head 16 until a new rod segment 22 is attached.

While the foregoing method for resetting the measurement of the angular position of the drill head 16 is currently preferred, it is anticipated to be within the scope of the present invention that the rotational position of the drill head 16 could be determined in any one of a number of different ways. For example, the actual rotational position of the drill head 16 could be constantly monitored and relayed to controller 24 through a variety of means including hard wire connection from the drill head 16 to the controller 24 or radio or other transmission from the drill head 16 to the controller 24. By using the actual monitored position of the drill head 16, the need to periodically reset the angular position of the drill head on the controller 24 and to subsequently calculate the position of the drill head 24 by means of calculating the amount of rotation of the drive 20 could be avoided.

Figure 10:
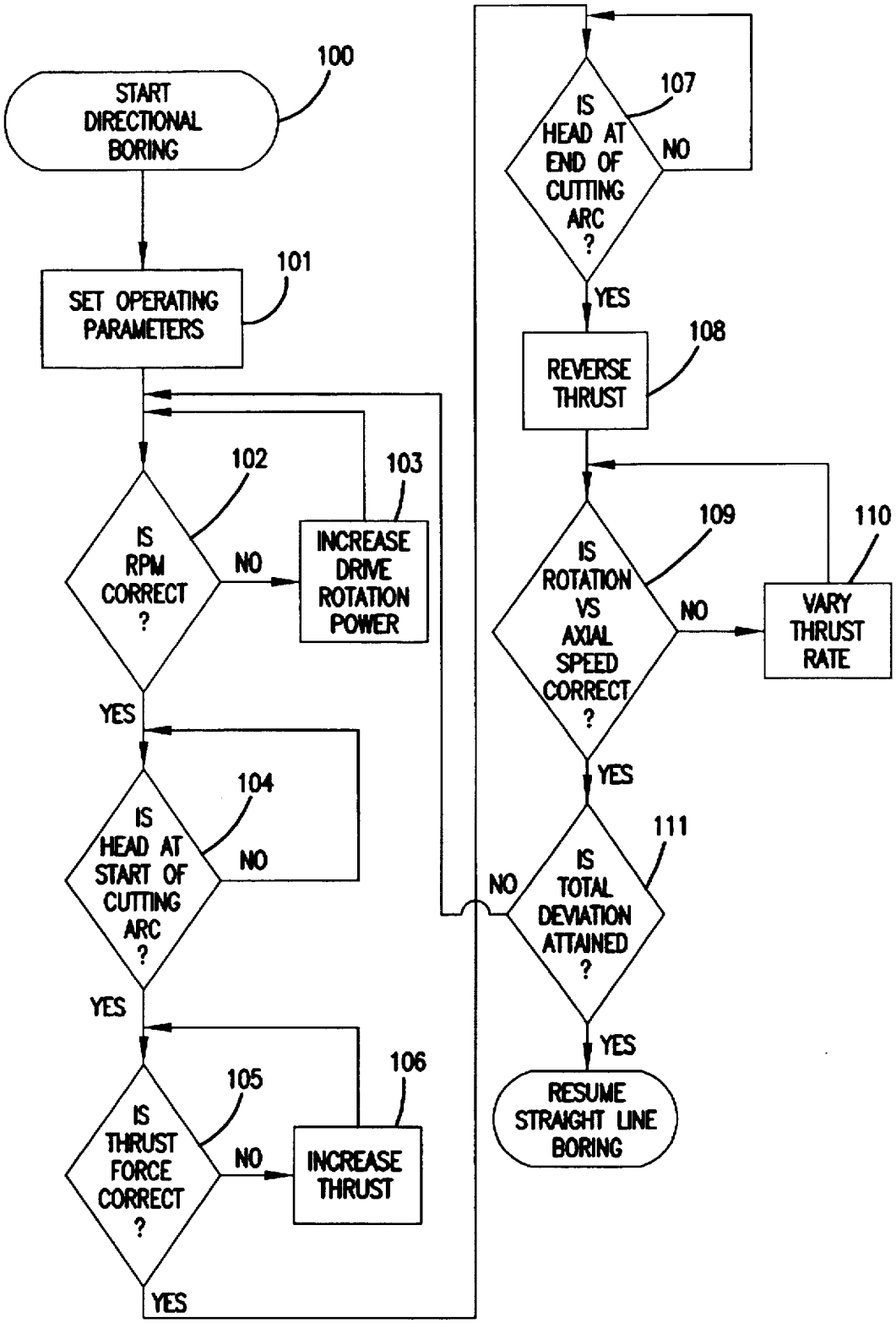
FIG. 10 is a flow chart illustrating a method of operation of the present invention.

FIG. 10 is a flow chart illustrating the steps of controller 24 for controlling the operation of the apparatus 10. After a period of boring in a straight line, it may be desired to deflect the direction of the boring. Therefore, the controller 24 controls directional boring at a start 100 of the directional boring process. At step 101, an operator may manually input to the controller 24 a variety of operating parameters. For example, the operator will input a desired angular direction of deflection. In the example previously given, the operator would input a twelve o'clock position to indicate to the controller 24 that is desired to deflect the drill head 16 vertically. Further, the operator will input the size of the arc for cutting. For example, the arc B in FIG. 8 is illustrated as being 120° from a ten o'clock position to a two o'clock position. Preferably, the controller 24 will permit selection of an arc between 0° to 180°.

An additional operating parameter to be set by an operator is a desired thrust for longitudinal advancement of the drill head 16. For example, for Caliche rock, a desired thrust of 2500 psi may be set. The operator also sets a desired rotational speed for the drill string 14 (for example, a rotational speed between 0 to 120 rpm). The operator additionally resets the starting or twelve o'clock position for the drill head 16. As previously indicated, the reset is done by detecting through remote transmissions or otherwise when the drill head is rotated with the cutting member 18 generally vertically aligned in a twelve o'clock position. The operator may then set a reset button indicating to the controller that the drill head is, in fact, in the twelve o'clock position. Afterwards, rotational increments of the drive 20 are monitored to calculate the rotational position of the drill head 16. The reset of the twelve o'clock position is reestablished each time a new drill segment 22 is added.

The operating parameters inputted at step 101 further include the establishment of a pullback distance. For example, the pullback distance could be from 2 to 6 inches depending on the geometry of the drilling head 16 so that during the pullback, the drill head 16 is not cutting into the desired ramp 28 as the drill head 16 is rotating outside of the arc B of rotation.

With the operating parameters inputted, the controller 24 can determine the starting point for the cutting operation. For example, where the desired deflection direction is known to be the twelve o'clock position and where the arc B is set at 120° by the operator, the controller establishes the starting point at the ten o'clock such that the desired direction of deflection (i.e., vertical in the aforementioned example) bisects the arc (120°) inputted by the operator at step 101. Accordingly, for the examples given, the controller 24 sets the ten o'clock position as the starting point.

At step 102, the controller 24 determines if the drill head 16 is rotating at the desired rotational velocity. If not, power is increased at step 103 to rotate the drill head 16.

When the desired rotation is achieved, the controller 24 determines if the drill head 16 has achieved the starting point (i.e., the ten o'clock position in the foregoing example) at step 104. If not, rotation is continued until the ten o'clock position is achieved.

Upon achieving the ten o'clock position, the controller 24 determines, at step 105, if the pressure on the rock face is the preset thrust pressure. If not, the thrust pressure is increased at step 106 until the desired preset thrust pressure is achieved.

At step 107, the controller 24 determines if the two o'clock position (the end of the cutting arc B in the aforementioned example) has been achieved. If not, rotation continues until the end of the cutting arc is achieved.

Upon achieving the end of the cutting arc, the thrust is reversed at step 108 in order to retract the drill head 16. During the reversal, the rotational velocity of the drill string 14 and the reversed longitudinal speed of the drill string 14 are compared at step 109 to match the relations of FIG. 10. If the thrust rate and the rotation are not in correct proportion, the thrust is varied at step 110. If the complete amount of directional deviation is not achieved as indicated at step 111, the process is continued. Otherwise, straight line boring with simultaneous rotation and forward longitudinal thrusting without retraction are commenced.

The sequence of drilling is schematically illustrated in FIGS. 5–7. In FIG. 5, a drill head 16 is shown fully inserted into a bore 200 with the drill teeth 18 and the drill head 16 at the twelve o'clock position. After the drill head 16 has rotated to the two o'clock position, the drill head is fully retracted as shown in FIG. 6, where the drill teeth and drill head are in the six o'clock position. Due to the retraction, the teeth 18 do not drill into and remove waste from the ramp 28. As the drill head 16 is subsequently advanced into the bore 200, the cam follower 40 engages the ramp 28 forcing the drill head 16 to deflect upwardly in the direction A (FIG. 7).

With the method of operation thus described, the drill string 14 continues to rotate throughout the operation. Cutting occurs within an arc B bisected by the desired direction A in which deflection of the drill head 16 is desired. The drill head 16 is retracted when the drill head 16 is in a rotational position outside of the arc B of cutting. By reason of the retraction, a ramp 28 is formed within the bore 200 which operates to deviate and push the drill head 16 in the desired direction. Further, throughout the cutting operation in arc B, the drill head 16 is moving across the face 201 of the rock such that the failing forces on the surface of the rock are forces acting in tensile and shear unlike the greater compression forces which must be overcome with the prior art devices.

From the foregoing detailed description of the present invention it has been shown how the objects of the invention have been attained in a preferred embodiment. Modifications and equivalents of the disclosed concepts such as those which readily occur to one skilled in the art are intended to be included within the scope of the claims which are appended hereto.

Alternative embodiments and modifications include stopping rotation of the drill head 16 during retraction. For example, when drilling through rock or other hard substances, the drill head 16 is both rotated and longitudinally advanced to go straight. To drill in a curved path (and using the above example where rotation and thrusting occur between a 10 o'clock and a 2 o'clock position to curve along a 12 o'clock direction), when the drill head 16 is in a 10 o'clock position, the drill head 16 is thrusted (i.e., longitudinally advanced) without rotation until the head 16 is urged against the rock base at a predetermined target pressure (for example, the aforementioned 2500 psi). The head 16 is then both thrusted and rotated throughout the arc B until the head 16 reaches the 2 o'clock position. Rotation is then stopped and the head 16 is retracted without rotation. Following such retraction, the head 16 is then rotated to the 10 o'clock position and the cycle is repeated.

For soft dirt, an alternative method may be used. In such applications, a pull back or retraction of drill head 16 is not required. Instead, the forward thrust of drill head 16 is relaxed when the head 16 is rotated outside of the cutting arc B. Therefore, when drill head 16 is in the 10 o'clock position, it is both rotated and axially advanced until head 16 achieves the 2 o'clock position. At the 2 o'clock position, rotation continues but axial advancement or thrust is stopped until the head 16 attains the 10 o'clock position at which point the cycle repeats. To drill in a straight line, the head 16 is continuously axially advanced and rotated.

What is claimed is:

1. A method for controlling a drilling apparatus for drilling a bore hole through a medium, said apparatus having a drill string terminating at a drill head which rotates about an axis of rotation, said drill head including a cutting member selected to cut at a point offset from said axis, said apparatus including means for longitudinally advancing said drill head, said method comprising:

advancing said drill head in a desired direction angled away from a straight path by:

a. applying a longitudinal force to said drill head when said cutting member is in an arc of rotation through which said desired direction passes; and b. relaxing said longitudinal force and longitudinally retracting said drill head when said cutting member is outside of said arc of rotation.

2. A method according to claim 1 comprising selecting said arc of rotation for said desired direction to bisect said arc of rotation.

3. A method according to claim 1 wherein said arc of rotation is between 0 degrees and 180 degrees.

4. A method according to claim 3 wherein said arc of rotation is 120 degrees.

5. A method according to claim 2 wherein said arc of rotation is between 0 degrees and 180 degrees.

6. A method according to claim 5 wherein said arc of rotation is 120 degrees.

7. A method according to claim 1 wherein said longitudinal force is selected for said cutting member to be applied against said medium to be drilled within a prescribed range of pressure for said cutting member to remove waste from said medium at a terminal end of said bore hole.

8. A method according to claim 1 wherein said retracting includes retracting said cutting member away from a face of said medium at a terminal end of said bore hole by an amount selected for said cutting member to avoid substantial cutting of said medium when said cutting member is outside of said arc of rotation.

9. A method according to claim 1 wherein said drill string includes an exterior end exposed out of said bore hole and mounted on a drive system for longitudinally advancing and rotating said drill string, said applying of said force including advancing said exterior end with said drive system.

10. A method according to claim 9 wherein said rotating includes rotating said exterior end with said drive system.

11. A method according to claim 1 wherein said drill string includes an exterior end exposed out of said bore hole and mounted on a drive system for rotating said drill string and for longitudinally advancing, relaxing, and retracting said drill head.

12. A method according to claim 1 wherein said rotating includes rotating said exterior end with said drive system.

13. A method according to claim 12 wherein said retracting includes retracting said exterior end with said drive system.

14. A method according to claim 1 wherein said drill string includes an exterior end exposed out of said bore hole and mounted on a drive system for rotating said drill string, a rotational position of said drill head determined by monitoring an amount of rotation of said exterior end by said drive system.

15. A method according to claim 9 wherein a rotational position of said drill head is determined by monitoring an amount of rotation of said exterior end by said drive system.

16. A method according to claim 9 wherein a rotational position of said drill head is determined by monitoring signals from said drill head indicating said rotational position.

17. A method according to claim 15 wherein said drill string includes a plurality of drill string segments sequentially joined at said drive system exterior of said bore hole, said method including measuring an actual rotational position of said drill head following addition of a segment to said drill string and subsequently determining a rotational position of said drill head by monitoring a subsequent amount of rotation of said exterior end by said drive system.

18. A method according to claim 1 further comprising repeatedly performing said applying, said relaxing, and said retracting, and still further comprising longitudinally advancing said drill head during said repetition for said drill head to be deflected toward said desired direction during said advancing by opposing surfaces of said medium defining said bore hole.

19. A method according to claim 18 wherein said cutting member is selected to cut waste from said medium at a terminal end of said bore hole with a remaining portion of said medium presenting a cam surface on a side of said bore hole opposite said desired direction, said method further including:

cutting said medium during said applying of said force to form said cam surface; and performing said longitudinal advancing for a cam follower on said drill string adjacent said drill head acting against said cam surface to deflect said drill head toward said desired direction as said drill head is longitudinally advanced.

20. A method according to claim 1 further comprising repeatedly performing said applying and said retracting and still further comprising longitudinally advancing said drill head following said retracting for said drill head to be deflected toward said desired direction during said advancing with said drill head deflected by opposing surfaces of said medium defining said bore hole.

21. A method according to claim 1 comprising advancing said drill head along said straight path by simultaneously rotating said drill head and applying a longitudinal force to said drill head.

22. A method according to claim 1 comprising advancing said drill head along said straight path by simultaneously rotating said drill head and applying a longitudinal force to said drill head.

23. A method according to claim 19 wherein said cutting member is selected to cut waste from said medium at a terminal end of said bore hole with a remaining portion of said medium presenting a cam surface on a side of said bore hole opposite said desired direction, said method further including:

cutting said medium during said applying of said force to form said cam surface; and performing said longitudinal advancing for a cam follower on said drill string adjacent said drill head acting against said cam surface to deflect said drill head toward said desired direction as said drill head is longitudinally advanced.

24. A method according to claim 1 comprising continuing rotation of said drill head during said retracting.

25. A method according to claim 1 comprising ceasing rotation of said drill head during at least a portion of said retracting and subsequently resuming rotating of said drill head to angularly position said drill head at a beginning point of said arc of rotation.

26. A drilling apparatus for drilling a bore hole through a medium, said apparatus comprising: a drill string terminating at a drill head within said bore hole;

a drive system exterior of said bore hole for engaging an exterior end of said drill string, said drive system having a first actuator for rotating said drill string about an axis of rotation coincident with a longitudinal axis of said drill string, and a second actuator for longitudinally advancing said drill head;

said drill head including a cutting member selected to cut at a point offset from said axis; and a controller that controls advancement of said drill head in a desired direction angled away from a straight path, wherein said controller controls said first and second actuators to apply a longitudinal force to said drill head when said cutting member is in an arc of rotation through which said desired direction passes, and further controls said second actuator to relax said longitudinal force and retract said drill string when said cutting member is outside of said arc of rotation.

27. A drilling apparatus according to claim 26 wherein said controller controls said second actuator to retract said drill string for said drill head to be moved away from a terminal end of said bore hole.

28. A drilling apparatus according to claim 26 wherein said cutting member is selected to cut waste from said medium at a terminal end of said bore hole with a remaining portion of said medium presenting a cam surface on a side of said bore hole opposite said desired direction.

29. A drilling apparatus according to claim 28 wherein said drill string includes a cam follower positioned on a side thereof to act against said cam surface to deflect said drill head toward said desired direction as said drill head is longitudinally advanced.

* * * * *